US008646816B2

(12) United States Patent
Dziurdzia et al.

(10) Patent No.: US 8,646,816 B2
(45) Date of Patent: Feb. 11, 2014

(54) MULTISTAGE DOOR LOCK

(75) Inventors: Jan Marian Dziurdzia, Heiligenhaus (DE); Thorsten Kuhnke, Mettmann (DE)

(73) Assignee: Rahrbach GmbH, Heiligenhaus (DE)

( * ) Notice: Subject to any disclaimer, the term of this patent is extended or adjusted under 35 U.S.C. 154(b) by 596 days.

(21) Appl. No.: 12/226,245

(22) PCT Filed: Apr. 13, 2007

(86) PCT No.: PCT/DE2007/000659

§ 371 (c)(1),
(2), (4) Date: Oct. 10, 2008

(87) PCT Pub. No.: WO2007/118465

PCT Pub. Date: Oct. 25, 2007

(65) Prior Publication Data

US 2009/0236865 A1 Sep. 24, 2009

(30) Foreign Application Priority Data

Apr. 13, 2006 (DE) ..... 10 2006 017 984
Apr. 27, 2006 (DE) ..... 10 2006 019 515

(51) Int. Cl.
*E05C 9/16* (2006.01)

(52) U.S. Cl.
USPC ..... 292/201; 292/216; 292/DIG. 69

(58) Field of Classification Search
USPC ..... 292/201, 226, 216, 336.3, DIG. 23, 292/DIG. 69; 126/191, 197, 201
See application file for complete search history.

(56) References Cited

U.S. PATENT DOCUMENTS

| | | | | |
|---|---|---|---|---|
| 2,877,038 | A * | 3/1959 | Kramer | 292/216 |
| 2,924,473 | A * | 2/1960 | Krause | 292/11 |
| 3,905,624 | A * | 9/1975 | Fujita | 292/11 |
| 4,230,350 | A * | 10/1980 | Gee et al. | 292/144 |
| 4,875,724 | A * | 10/1989 | Gruber | 292/216 |
| 4,936,611 | A * | 6/1990 | Palvolgyi | 292/28 |
| 4,968,073 | A * | 11/1990 | Kuhlman | 292/201 |
| 5,048,877 | A * | 9/1991 | Rogers et al. | 292/110 |
| 5,853,060 | A * | 12/1998 | Chao et al. | 180/69.2 |
| 5,979,951 | A * | 11/1999 | Shimura | 292/216 |
| 6,010,165 | A * | 1/2000 | Santarelli et al. | 292/216 |
| 6,422,616 | B1 * | 7/2002 | Wortmann et al. | 292/216 |
| 6,439,623 | B1 * | 8/2002 | Lohfeld et al. | 292/201 |
| 6,547,291 | B1 * | 4/2003 | Schwaiger | 292/216 |
| 6,695,360 | B1 * | 2/2004 | Forsell et al. | 292/216 |
| 7,040,674 | B2 * | 5/2006 | Lomicka et al. | 292/201 |
| 7,261,337 | B2 * | 8/2007 | Nakagome et al. | 292/216 |
| 7,334,823 | B2 * | 2/2008 | Courter et al. | 292/201 |
| 7,441,814 | B2 * | 10/2008 | Ponn et al. | 292/216 |

(Continued)

FOREIGN PATENT DOCUMENTS

| | | |
|---|---|---|
| DE | 3903274 | 8/1989 |
| DE | 19904663 | 8/2000 |
| DE | 19916191 | 10/2000 |

*Primary Examiner* — Carlos Lugo
*Assistant Examiner* — Mark Williams
(74) *Attorney, Agent, or Firm* — James Creighton Wray

(57) ABSTRACT

Disclosed is an electromechanical locking device for a door of an appliance, particularly an oven. Said locking device comprises a lock (1) on the appliance and a hook (2) on the door. The lock (1) is provided with bolts (3, 4) on both sides of the hook (2), said bolts (3, 4) allowing the door to be opened and closed in an intermediate latched stage and a main latched stage.

12 Claims, 4 Drawing Sheets

(56) References Cited

U.S. PATENT DOCUMENTS

| | | | | |
|---|---|---|---|---|
| 7,455,336 | B2 * | 11/2008 | Baumchen et al. | 292/216 |
| 7,614,670 | B2 * | 11/2009 | Hayakawa et al. | 292/216 |
| 7,644,964 | B2 * | 1/2010 | Bushey et al. | 292/342 |
| 2002/0096889 | A1 * | 7/2002 | Nelsen et al. | 292/201 |
| 2004/0113437 | A1 * | 6/2004 | Hayakawa et al. | 292/201 |
| 2004/0189016 | A1 * | 9/2004 | Fukunaga et al. | 292/201 |
| 2005/0121919 | A1 * | 6/2005 | Smock et al. | 292/110 |
| 2005/0200137 | A1 * | 9/2005 | Nelsen et al. | 292/201 |
| 2006/0076784 | A1 * | 4/2006 | Kachouh et al. | 292/216 |
| 2006/0170224 | A1 * | 8/2006 | Mitchell et al. | 292/216 |
| 2007/0114802 | A1 * | 5/2007 | Johnson et al. | 292/340 |
| 2007/0278802 | A1 * | 12/2007 | Hanisch | 292/340 |
| 2007/0296224 | A1 * | 12/2007 | Courter | 292/109 |
| 2008/0224482 | A1 * | 9/2008 | Cumbo et al. | 292/216 |

* cited by examiner

MULTISTAGE DOOR LOCK

This application claims the benefit of German Application No. 10 2006 017 984.6 filed Apr. 13, 2006, German Application No. 10 2006 019 515.9 filed Apr. 27, 2006, and PCT/DE2007/000659 filed Apr. 13, 2007, which are hereby incorporated by reference in their entirety.

The invention concerns an electromechanical locking device for an appliance door, in particular an oven, with a lock on the appliance and a hook on the door.

There is a multitude of appliance doors in which the opening process is carried out in two stages. The hook is first released from the appliance lock from the main latched stage into an intermediate latched stage, so that a direct opening of the door does not occur. The background for this is represented, for example, in the case of toaster ovens, by the requirement that the heated air should first escape from the interior of the oven, so that the operating personnel will not inhale said air. A large gap is rather created between oven and door in the intermediate latched stage, so that the air can escape past the body of the operating personnel in lateral direction. Only then can the door be completely released through a second, separate manipulation.

It is an object of the invention to improve the locking functions and thus create a more reliable and easier to manage appliance door.

This object is attained by arranging bolts in the lock on both sides of the hook, which are designed so as to allow opening and closing the door in an intermediate latched stage and in a main latched stage.

Bolts, which interact together to make possible the functions of the main and intermediate latched stages, are arranged on both sides of the hook. The door is first moved manually into the intermediate latched stage, and is then pulled shut in the main latched stage via a drive motor by means of an interaction of the bolts.

This interaction is considerably facilitated if both bolts have mutually corresponding locking surfaces, so that when the door is opened and/or closed, the corresponding latched positions are produced. The locking surfaces of the bolts rest one against the other or slide over each other when the door is opened or closed.

For this purpose, it is proposed to configure a first bolt as a swivel-mounted rotary door latch. The rotary door latch has an arm beside a region designed to correspond to the hook, whose end is configured so as to correspond to the neighboring hook, as well as also another arm, via which the rotary door latch can be actuated by means of the drive motor.

In this regard, the rotary door latch can be provided with an elongated holder for receiving the hook. In this way a kind of recess with an end configured as a hub-like projection is obtained which is suitable, in turn, for creating a locking connection with the hook. The appliance door slips thus with the hook into the recess when the door is closed, and is then enclosed by the projection after a corresponding actuation of the rotary door latch in order to create a locking connection. The recess is configured therein in such a way that the hook is in the main latched stage in its end position.

In addition, a second bolt is positioned on the opposite side of the hook with respect to the rotary door latch. Each bolt influences the operation of the other bolt, without there being any possibility of a mutual interference. An increased number of functions can be obtained if the second bolt is configured in two parts. One part of the bolt has one end on the side of the hook and the second end is in direct or indirect contact with the drive motor.

The invention conceives in particular that the second bolt has a locking lever on the side of the hook and a locking pawl. The former has one end in the shape of a projection or catch, which has a configuration that corresponds to the hook and is suitable for making a connection with said hook in the intermediate latched stage when the door is closed. Between this locking lever and the drive motor the other part of the bolt, the locking pawl, is located, which keeps the locking lever out of the travel path of the hook or releases said locking lever for locking upon release of a corresponding contact.

This can be most, effectively implemented when the locking lever and the locking pawl are connected to each other by means of a mortise and tenon joint. In this regard, the invention conceives in particular that the locking lever has a tenon, while the locking pawl has a recess at the end thereof facing the tenon, so that the mortise and tenon joint is released when the locking pawl is moved corresponding to the other end thereof by the drive motor or is moved into another position by the rotary door latch.

Locking surfaces are provided between the rotary door latch and the locking pawl. It is best herein to configure the latch surfaces as recesses and/or projections, so that several positions of the locking surfaces with respect to each other are possible, which will determine the intermediate or main latched position of the lock.

The invention proposes in particular to provide the rotary door lock with two projections and the locking pawl with one projection. The projection of the locking pawl is arranged between the two projections of the rotary door latch when the door is in the intermediate latched position; when the door is closed to the main latched position, the upper projection of the rotary door latch also slides behind the projection of the locking pawl.

An additional embodiment of the invention proposes to equip both bolts with status sensors in order to be able to check the open state of the lock in a contactless or contacted manner, and if necessary control the opening and/or closing of the door. In this regard, both status sensors can function independently from each other.

It was already pointed out that the motor function is an essential component of the locking device according to the invention. In addition to an exclusively electrical opening, it is likewise possible to implement an exclusively manual opening function in this manner. In any case, it is recommended that the bolts be controllable directly or indirectly by means of separate drive motors. For this purpose, it is proposed to set a cam wheel in rotation by means of the respective drive motor, whereupon the cam wheel can be brought into contact with the bolts.

One embodiment proposes the use of rotatably mounted cams in order to transfer the torques exerted by the drive motors, which are mounted on the wheels. Both wheels are independently controlled by means of the drive motors with respect to the opening and the closing process.

With regard to the hook, the invention proposes providing the hook with a pin on its front side and a wedge at a distance therefrom on the inside of said hook. In this case, the pin is configured so as to correspond to the recess in the rotary door latch, and the wedge corresponds to the locking pawl. In this way, a good connection is ensured between the rotary door latch and the pin in the latched stages, on the one hand, and it is ensured, on the other, that a guide contour for the locking lever is created by means of the wedge to provide the latter with temporary additional support.

The invention is characterized in particular in that an electromechanical locking device is created for an appliance door, with which said door can be reliably and securely opened and closed. Differently configured and working bolts can be provided for this purpose on both sides of the door hook. The two bolts operate essentially independently from each other, so that they are driven by different drive motors, but also operate in a mutually dependent manner in such a way that they have mutually matching locking surfaces, which ensure the opening and/or closing of the door, respectively.

Additional details and advantages of the object of the invention are obtained from the following description of the corresponding figures, in which a preferred embodiment with the necessary details and individual parts is represented. In the drawings:

DETAILED DESCRIPTION OF THE PREFERRED EMBODIMENTS

Figure 1:
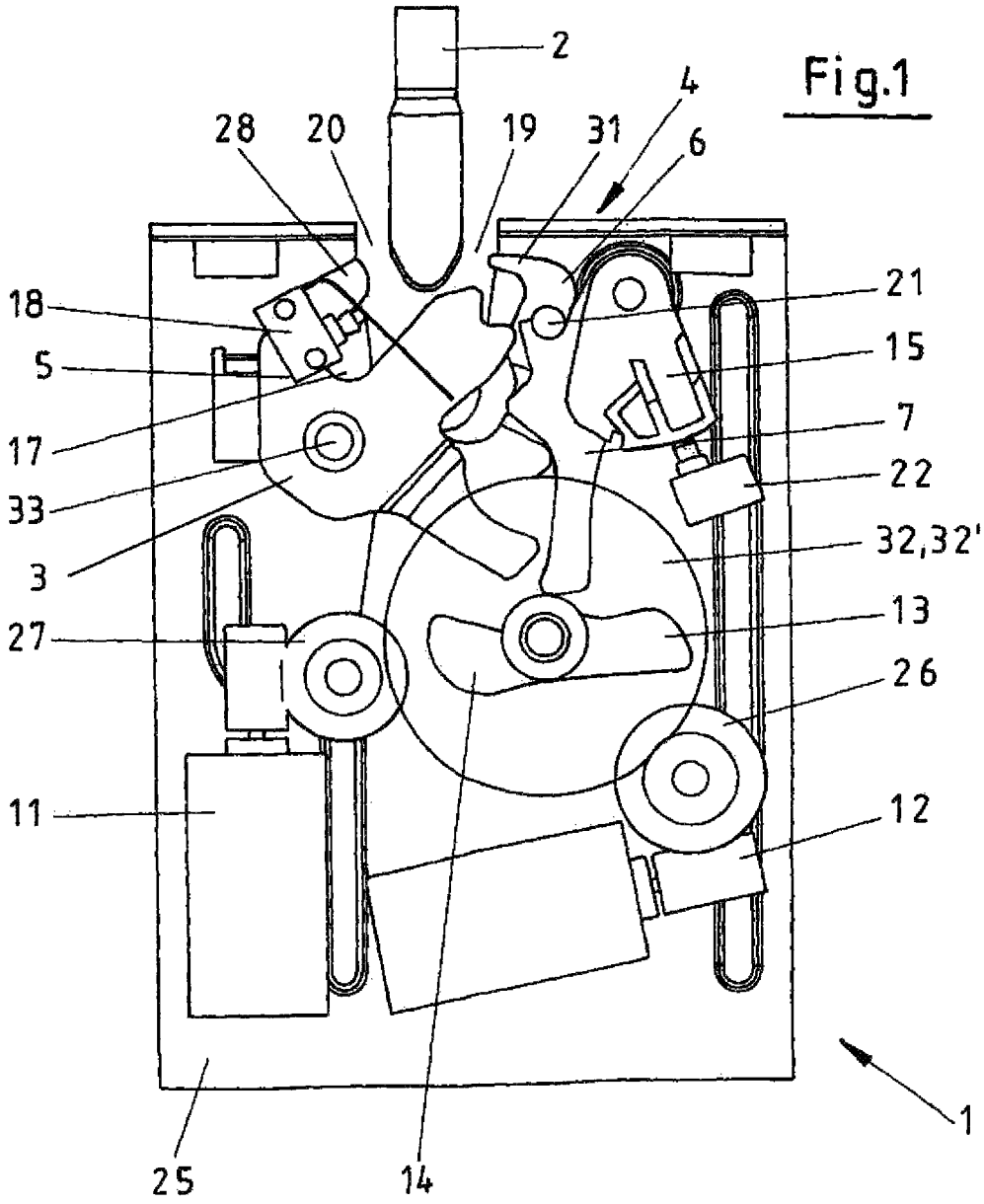
FIG. 1 shows an illustration of the inner mechanism of the lock.

FIG. 1 shows the interior of the lock 1 with its various components. The symmetrically designed hook 2, which is not inserted herein in the lock 1, can be seen first. On both sides 19, of the lock 1 are located bolts 4, 3. The former has a two-part design and has the locking pawl 7 in addition to the locking lever 6 on the side of the hook. The latter is configured as a rotary door latch 5 on the other side 20 and is rotatably mounted around the axis 33. Contactless or contacted state sensors 18, 22 with actuators 15 are used to scan the open state of the lock and accordingly to control the opening and/or closing of the electromechanical lock. The cam 14 is moved against the locking pawl 7 by the reduction gear 27 and by the drive motor 11 for the opening function when the wheel 32 is turning. The cam 13 or the wheel 32', which is concealed herein, is moved against the rotary door latch 5 by the drive motor 12 or by the reduction gear 26. Reference number 25 identifies the base plate; all connection points are integrated into the housing of the lock 1.

Figure 2:
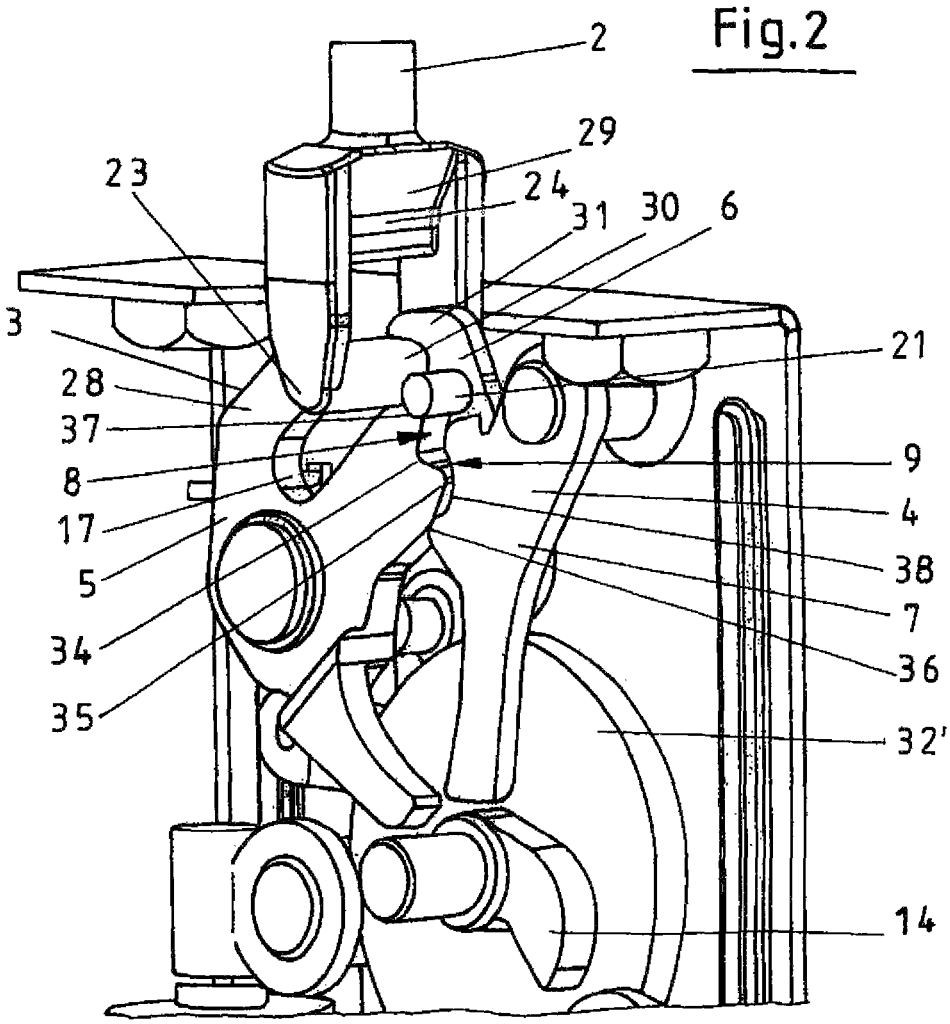
FIG. 2 shows a section thereof in perspective view.

FIG. 2 illustrates the locking function, because here the hook 2 is shown in an intermediate latched stage, in which only one locked connection is made with the bolt 4. The configuration of the hook 2 with the pin 30 on the front side 23, and with the wedge 29 on the inside 24 of hook 2 is readily apparent. The latter is used to form a type of guide contour for the bolt 4. The two bolts 3, 4 configured in the shape of a convex, elongated recess 17 in the region of the rotary door latch 5 are provided with a nose-like projection 28 and also with a likewise nose-like end 31 in the region of the locking lever 6. The corresponding configuration of the rotary door latch 5 and locking lever 6 in the region of the latch surfaces 8 and 9 with the projections 35 and 37 on the side of the rotary door latch, and also the recess 34 and/or the projection 36 on the side of the locking pawl, and the recess 38, are all readily apparent. The mortise and tenon joint 21 is exposed here.

Figure 3:
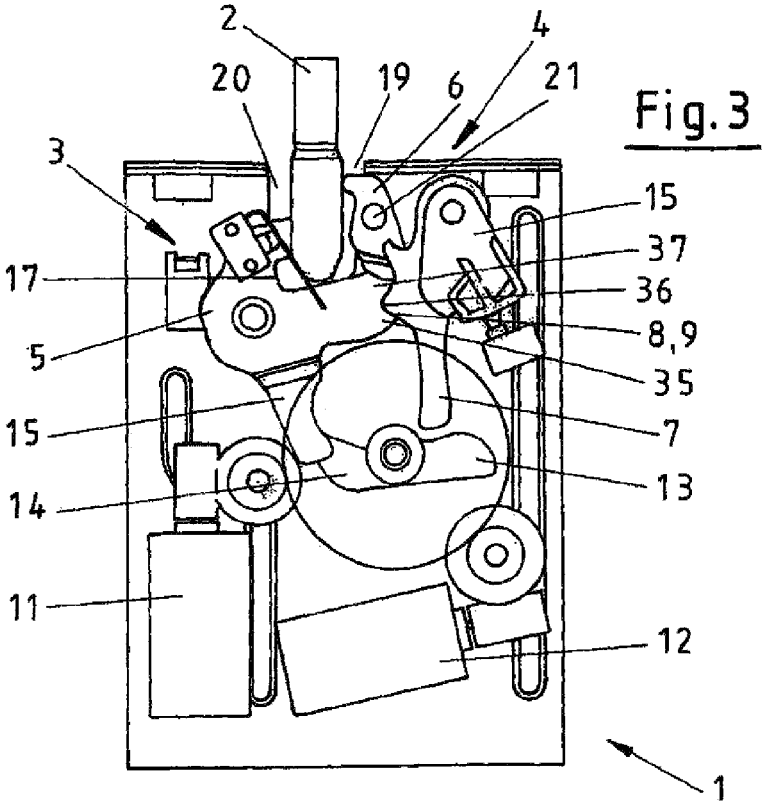
FIG. 3 shows a lock in the intermediate latched position during closing.

FIG. 3 shows the lock 1 in the intermediate latched position during closing. The rotary door latch 5 is locked by the locking pawl 7; the locking surfaces 8, 9 rest against each other. Stated more precisely, the projection 36 on the side of the locking pawl is located in the recess 34 on the side of the rotary door latch between the two projections 35 and 37. The locking lever 6 is released and rests against the hook 2; the mortise and tenon joint 21 is released. The cam wheels 13, 14 are in the basic position.

Figure 4:
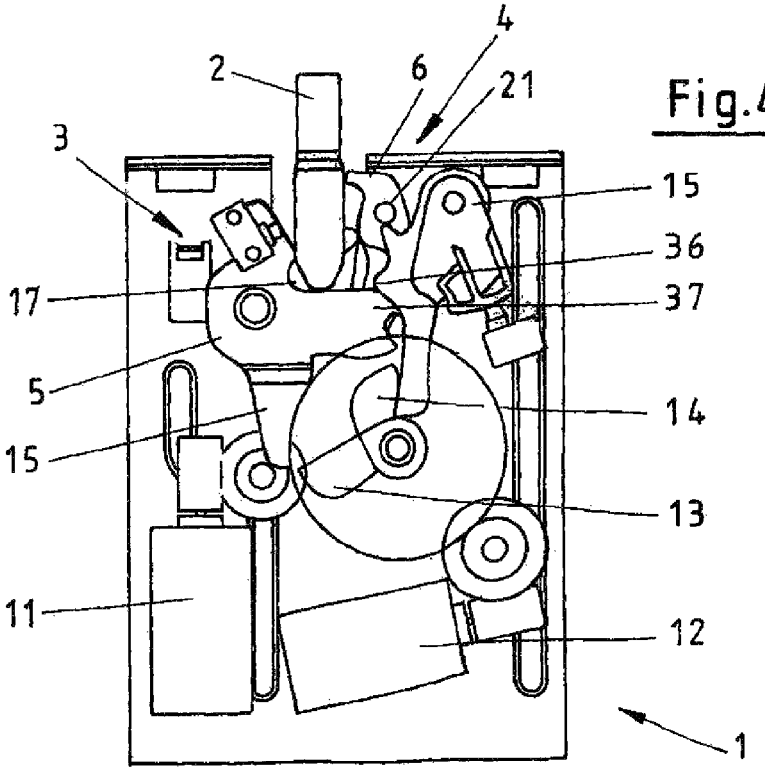
FIG. 4 shows a lock in the main latched position.

In order to arrive at the main latched position illustrated in FIG. 4, a force is exerted on the rotary door latch 5 via cam 13 and said latch is pulled into the main latched position, in which the hook 2 is pulled farther into the recess 17 of the rotary door latch 5 in comparison with the illustration in FIG. 3, and has reached its end position. In this case, the lock 1 pulls the hook 2 automatically from the intermediate latched position into the main latched position, whereupon the rotary door latch 5 and locking lever 6 are moved into a new latched position with respect to each other, in which the upper protrusion 37 on the side of the rotary door latch is now located underneath the projection 36 on the side of the locking pawl.

Figure 5:
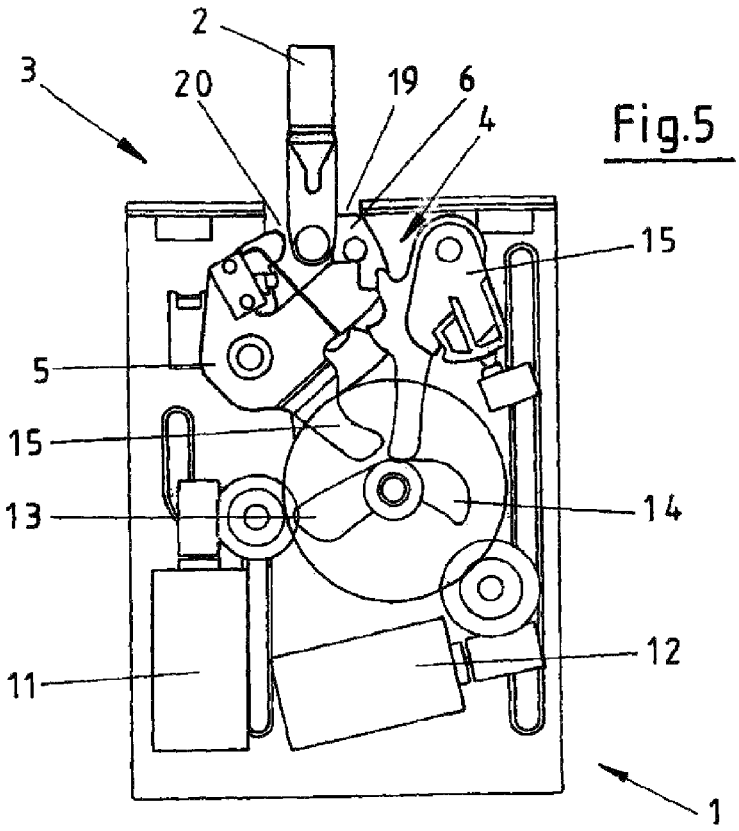
FIG. 5 shows a lock in the intermediate latched position during opening.

The lock 1 moves from the main latched position illustrated in FIG. 4 into the intermediate latched position illustrated in FIG. 5. For this purpose, an opening pulse is transmitted by a sensor or by an appliance program to the cam 14, which actuates the locking pawl 7 and opens this part of the lock. The hook 2 is thus caught in the locking lever 6, the lock 1 moves into the intermediate latched position, in which the air, for example, can escape from a toaster.

Figure 6:
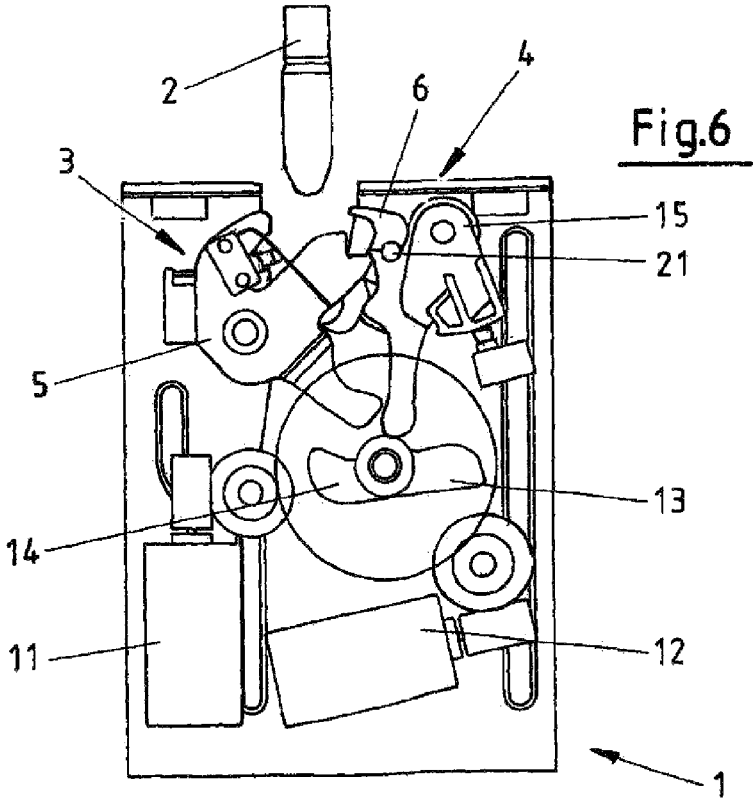
FIG. 6 shows the opened lock.

FIG. 6 finally shows the open state, as was already shown earlier in FIG. 1, in which the rotary door latch 5 is unlocked, the opening pulse for the locking pawl 6 again comes from a sensor or an appliance program, the cam wheel 14 actuates again the locking lever 6 and opens the lock, the mortise and tenon joint 21 is maintained between the two parts of the bolt 4, the locking lever 6 and locking pawl 7 mutually support each other, and the hook 2 is released.

The invention claimed is:

1. Apparatus comprising an electromechanical locking device on an oven appliance and an oven appliance door, the locking device further comprising a lock (1) on a side of the oven appliance and a hook (2) on a side of the door, wherein a first bolt (3) and a second bolt (4) are arranged in the lock (1) and are positioned to engage the hook from opposite sides of the hook (2), wherein the second bolt (4) further comprises a locking lever (6) on one side of the hook and a locking pawl (7) connected to the locking lever, and wherein said bolts are configured to sequentially engage the hook from the one side and then from a second side so as to make possible closing the door in an intermediate latched stage and in a main latched stage and to sequentially disengage the hook when opening the door from the main latched stage to the intermediate latched stage.

2. The apparatus of claim 1, characterized in that both bolts (3, 4) have mutually engaging latch surfaces (8, 9).

3. The apparatus of claim 1, characterized in that the first bolt (3) is configured as a swivel-mounted rotary door latch (5).

4. The apparatus of claim 3, characterized in that the rotary door latch (5) has an elongated holder (17) for the hook (2).

5. The locking device of claim 3, characterized in that the second bolt (4) is arranged on the opposite side (19) of the hook (2) with respect to the rotary door latch (5).

6. The apparatus of claim 2, characterized in that the locking surfaces (8, 9) are configured as recesses (34, 38) and/or projections (35, 36, 37).

7. The apparatus of claim 6, characterized in that the rotary door latch has two projections (35, 37) and the locking pawl (7) has one projection (36).

8. The apparatus of claim 6, characterized in that both bolts (3, 4) are equipped with status sensors (18, 22).

9. The apparatus of claim 1, characterized in that the bolts (3, 4) are controlled directly or indirectly via separate drive motors (11, 12).

10. The apparatus of claim 9, characterized in that rotatably mounted cams (13, 14) serve to transfer the torque exerted by the drive motors (11, 12).

11. The apparatus of claim 1, characterized in that the hook (2) has a pin (30) on its front (23) and a wedge (29) at a distance from the pin.

12. Apparatus comprising an oven and an electromechanical oven door lock adapted for intermediate latching and subsequent main latching when closing an oven door and adapted for sequentially disengaging a main latch and then disengaging an intermediate lock when opening the oven door, further comprising the oven door, a hook connected to the oven door, a pin connected to the hook, a first bolt comprising a main rotary latch having a latching recess, a first lever, a first locking surface connected to the first lever and a first pawl connected to the first lever, a second bolt comprising a locking lever having the intermediate lock and the second bolt comprising a second lever, a second locking surface connected to the second lever and a second pawl connected to the second lever, motor driven cams adapted to sequentially contact the second and first pawls for intermediate engagement of the lock on the locking lever of the second bolt with the hook release of engagement with the pin of the hook of the latching recess of the first bolt with the pin of the hook and opening the door by sequentially disengaging the recess of the first bolt from the pin of the hook, and subsequently disengaging the lock on the locking lever of the second bolt from the hook.

* * * * *